US007735267B1

(12) United States Patent
Ayers, Jr.

(10) Patent No.: US 7,735,267 B1
(45) Date of Patent: Jun. 15, 2010

(54) STRUCTURAL VENTED ROOF DECK ENCLOSURE SYSTEM

(76) Inventor: W. Howard Ayers, Jr., 7540 Lupre Dr., McCalla, AL (US) 35111

( * ) Notice: Subject to any disclaimer, the term of this patent is extended or adjusted under 35 U.S.C. 154(b) by 190 days.

(21) Appl. No.: 11/832,082

(22) Filed: Aug. 1, 2007

(51) Int. Cl.
*E04B 7/00* (2006.01)

(52) U.S. Cl. ..... 52/96; 52/60; 52/302.6

(58) Field of Classification Search ..... 52/58, 52/60, 62, 94, 96, 169.5, 302.1, 302.3, 302.6, 52/61, 95, 198, 199, 302.7
See application file for complete search history.

(56) References Cited

U.S. PATENT DOCUMENTS

| | | | | | |
|---|---|---|---|---|---|
| 1,028,725 | A | | 6/1912 | Hodgson | |
| 2,214,183 | A | | 9/1940 | Seymour | |
| 2,645,824 | A | | 7/1953 | Titsworth | |
| 2,857,861 | A | * | 10/1958 | Trostle | 52/94 |
| 3,024,573 | A | * | 3/1962 | McKinley | 52/96 |
| 3,368,473 | A | | 2/1968 | Sohda et al | |
| 3,435,976 | A | | 4/1969 | Owens | |
| 3,633,659 | A | | 1/1972 | Ohlsson | |
| 3,738,068 | A | * | 6/1973 | Attaway | 52/60 |
| 3,797,180 | A | | 3/1974 | Grange | |
| 3,797,181 | A | | 3/1974 | Nievelt | |
| 3,972,164 | A | | 8/1976 | Grange | |
| 4,214,510 | A | | 7/1980 | Ward | |
| 4,295,415 | A | | 10/1981 | Scneider, Jr. | |
| 4,371,031 | A | | 2/1983 | Bernander et al. | |
| 4,379,381 | A | | 4/1983 | Holcombe | |
| 4,382,435 | A | | 5/1983 | Brill-Edwards | |
| 4,423,572 | A | | 1/1984 | Tor | |
| 4,429,503 | A | | 2/1984 | Holliday | |
| 4,435,926 | A | | 3/1984 | Struben | |
| 4,446,661 | A | | 5/1984 | Jonsson et al. | |
| 4,472,913 | A | * | 9/1984 | Hickman | 52/96 |
| 4,570,396 | A | | 2/1986 | Struben | |
| 4,635,419 | A | | 1/1987 | Forrest | |
| 4,642,958 | A | | 2/1987 | Pewitt | |
| 4,677,903 | A | | 7/1987 | Mathews, III | |
| 4,736,561 | A | | 4/1988 | Lehr et al. | |
| 4,783,942 | A | | 11/1988 | Nunley et al. | |
| 4,852,314 | A | | 8/1989 | Moore, Jr. | |
| 4,890,427 | A | | 1/1990 | Rayburn | |
| 4,977,714 | A | | 12/1990 | Gregory, Jr. | |
| 5,272,846 | A | * | 12/1993 | Kelley et al. | 52/96 |

(Continued)

*Primary Examiner*—Richard E Chilcot, Jr.
*Assistant Examiner*—T. A.
(74) *Attorney, Agent, or Firm*—Kenneth M. Bush; Bush Intellectual Property Law

(57) ABSTRACT

A structural support member for use in a roof deck system that is supported on an upper surface of a roof deck support structure. The primary embodiment comprises a substantially vertical outer segment, a substantially horizontal lower segment connected to the outer segment, a substantially horizontal upper segment connected to the outer segment, a substantially horizontal intermediate segment connected to the outer segment between the upper and lower segments, and a substantially vertical inner segment connected to the intermediate segment and the lower segment. The lower segment is secured to the upper surface of the support structure and supports a metal deck. The upper, intermediate, and outer segments form a C-shaped cavity for receiving the end of a barrier material, such as insulation or concrete, which is supported on the metal deck. The lower, intermediate, inner, and outer segments form an elongated channel that preferably has a plurality of vent holes therethrough.

12 Claims, 12 Drawing Sheets

U.S. PATENT DOCUMENTS 5,335,462 A 8/1994 Park
5,347,768 A 9/1994 Pineda
5,433,050 A 7/1995 Wilson et al.
5,473,847 A 12/1995 Crookston
5,487,247 A 1/1996 Pigg
5,586,414 A 12/1996 Tawzer
5,761,864 A 6/1998 Nonoshita
6,023,922 A 2/2000 Lancaster
6,052,959 A * 4/2000 LaBrosse ..... 52/302.6
6,061,978 A 5/2000 Dinwoodie et al.
6,088,992 A 7/2000 Nunley
6,185,895 B1 2/2001 Rettew
6,237,293 B1 5/2001 Gembala
6,647,675 B1 11/2003 Castellanos
6,751,923 B1 6/2004 Nunley
6,780,099 B1 8/2004 Harper
7,143,557 B1 12/2006 Ayers, Jr.
2002/0178671 A1 * 12/2002 Gembala ..... 52/302.6
2004/0154253 A1 * 8/2004 Nunley ..... 52/506.01

* cited by examiner

STRUCTURAL VENTED ROOF DECK ENCLOSURE SYSTEM

FIELD OF THE INVENTION

The present invention relates to roof systems, and more particularly, to roof deck systems having the edges of the roof decks enclosed within uniform structural supports.

BACKGROUND OF THE INVENTION

Commercial roof systems commonly comprise a roof deck system utilized to support a roof membrane. Some of these commercial roof systems comprise a metal deck, such as a sheet of corrugated steel, mounted on a support structure such as steel or wooden roof beams. The metal deck supports a barrier material, such as rigid insulation or lightweight concrete, which, in turn, supports the roof membrane. Along the terminal edges of the roof deck system, pressure treated wood is frequently used as blocking, wherein the wood blocking is supported on the metal deck and lies immediately adjacent to the barrier material.

Several problems have arisen in the foregoing systems. For example, the wood blocking must be custom designed on-site, resulting in a significant increase in construction expense. The on-site nature of the design and construction of conventional systems reduces the quality of the finished product because it is not manufactured under controlled conditions. In addition to difficulties associated with construction, conventional systems have typically not been designed to provide stable support for finished fascia material and other components of roof deck terminations. Further, the wood blocking suffers problems inherent with such materials such as rotting, warping, burning, shrinking, and being subject to attack by termites. The chemicals used in treating, the wood blocking to overcome its inherent problems frequently results in corrosion of the metal decks, metal fasteners, and other metal materials in contact with the treated wood. Finally, current low-slope rooting systems do not provide exit venting for the roof deck at its perimeters.

What is needed, and is not found in the prior art, is a roof deck system that overcomes the problems of the foregoing prior art systems. The present invention is related to the technology disclosed in U.S. Pat. Nos. 6,237,293 to Gembala, 6,751,923 to Nunley, and 7,143,557 to Ayers, the disclosures of which are incorporated herein by reference.

SUMMARY OF THE INVENTION

The present invention comprises a structural support member for use in a roof deck system that is supported on an upper surface of a roof deck support structure. The primary embodiment comprises a substantially vertical outer segment having a first end and a second end, a substantially horizontal lower segment having a first end connected to the outer segment and a second end, a substantially horizontal upper segment having a first end connected to the outer segment and a second end, a substantially horizontal intermediate segment having a first end connected to the outer segment between the upper and lower segments and a second end, and a substantially vertical inner segment having a first end connected to the second end of the intermediate segment and a second end connected to the lower segment between the first and second ends thereof. The lower segment of the structural support member is secured to the upper surface of the support structure and supports a metal deck. The upper, intermediate, and outer segments of the structural support member form a C-shaped cavity for receiving the end of a barrier material, such as rigid insulation or lightweight concrete, which is supported on the metal deck. The lower, intermediate, inner, and outer segments of the structural support member form an elongated channel that preferably has a plurality of vent holes therethrough.

In a second embodiment, the support structure has a substantially vertical outer surface that intersects its upper surface at a corner and the outer segment of the structural support member overlaps the outer surface of the support structure and is substantially co-planar therewith. In a third embodiment, the structural support member further comprises an angled segment (i.e. cant) having a first end connected to the second end of the outer segment and a second end connected to the upper segment. The third embodiment can be modified for use with a support structure having a substantially vertical outer surface that intersects its upper surface at a corner, wherein the outer segment of the structural support member overlaps the outer surface of the support structure and is substantially co-planar therewith, or alternatively, the third embodiment can be modified for use with a support structure having its upper surface intersect a substantially vertical parapet wall surface at a corner, wherein the outer segment of the structural support member is secured to the parapet wall surface and is substantially co-planar therewith.

The embodiments of the present invention provide structural support for metal decks and replace the wood blocking, heavy structural steel angles or bent plates used in prior art systems with a cold formed galvanized steel that is stronger and lighter, thus reducing both material and labor costs. Further, the structural support members can be used at any of the edges of the roof deck, whether terminal or otherwise (e.g. skylights).

These and other features of the invention will become apparent from the following detailed description of the preferred embodiments of the invention.

DETAILED DESCRIPTION OF THE PREFERRED EMBODIMENTS

Figure 1:
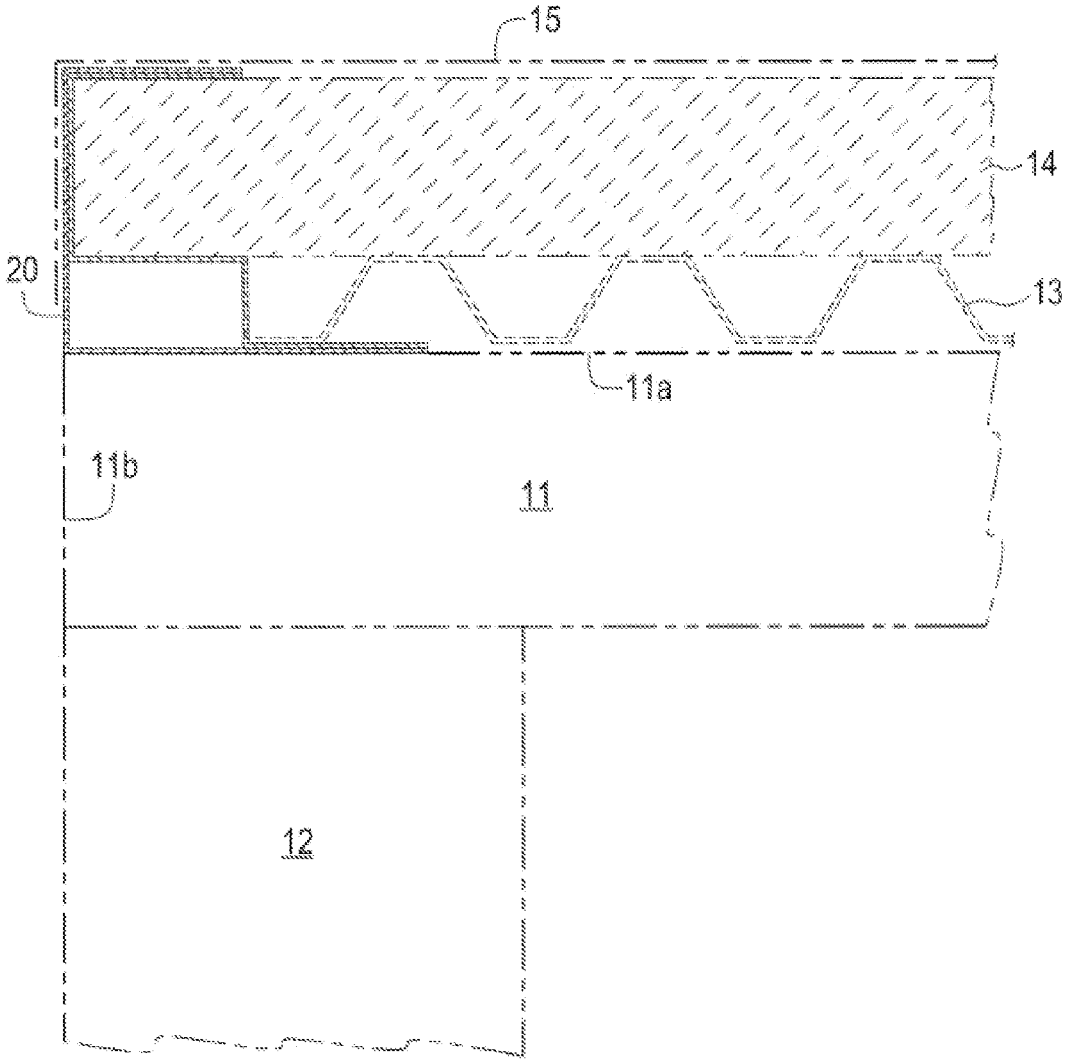
FIG. 1 is a side sectional view of a first embodiment of the present invention.
Figure 2:
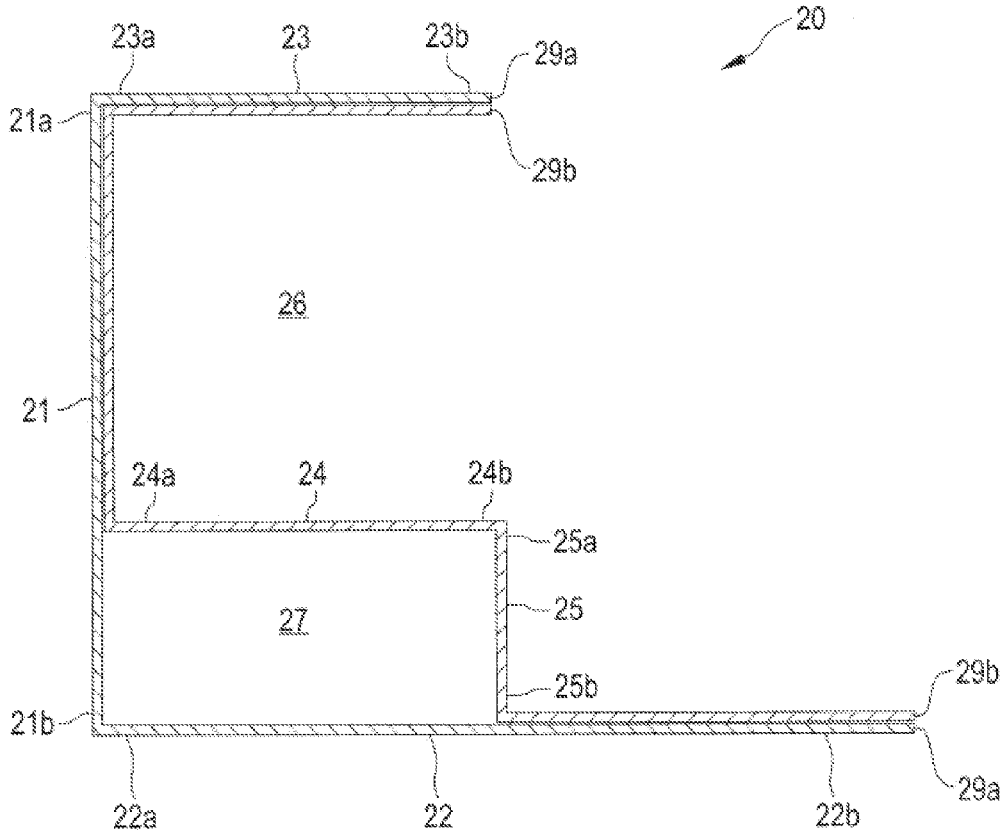
FIG. 2 is a side sectional view of the structural support member used in the embodiment of FIG. 1.
Figure 3:
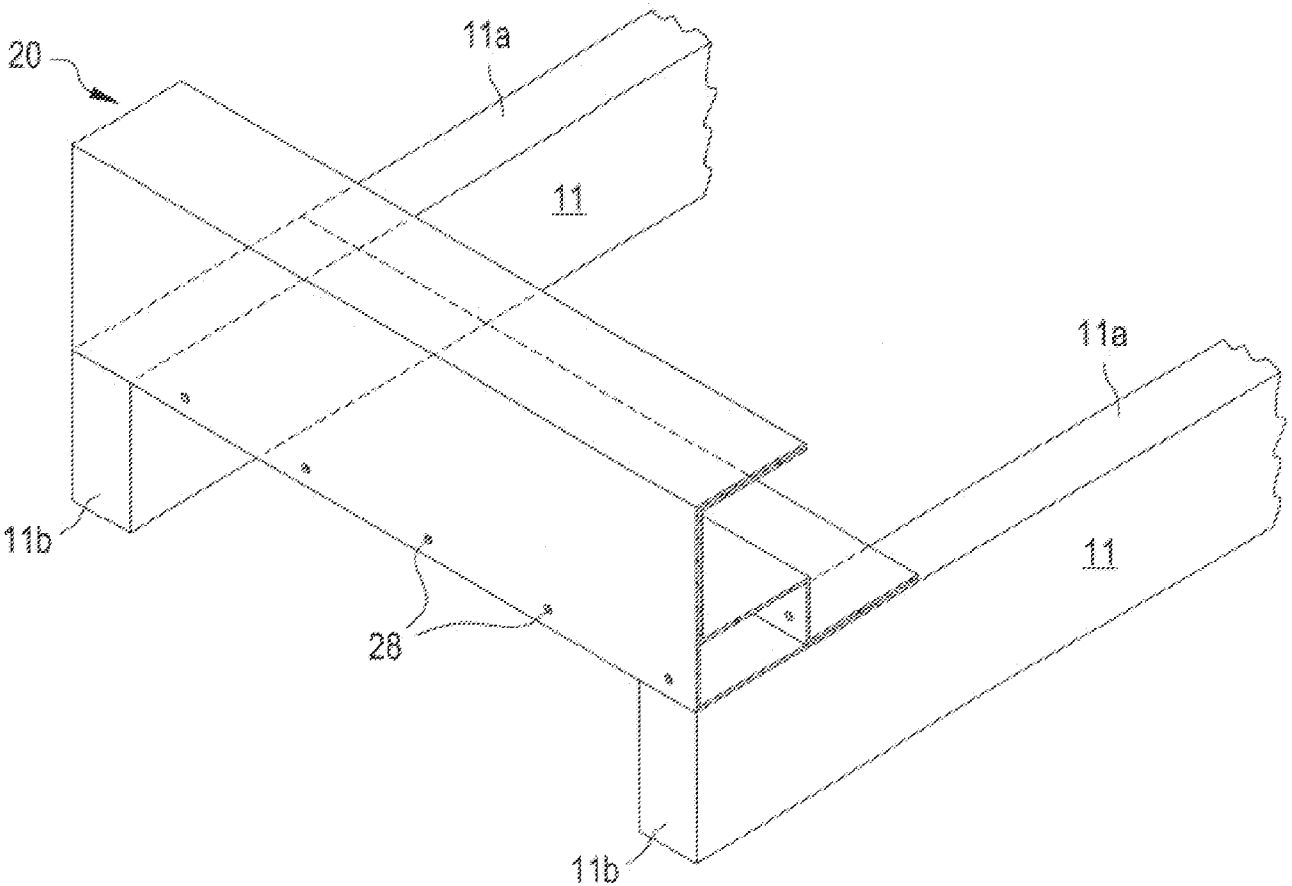
FIG. 3 is a perspective view of the structural support member used in the embodiment of FIG. 1 supported on joists.

The primary embodiment of the present invention is shown in FIGS. 1-3, wherein a structural support member 20 is supported on an upper surface 11*a* of a roof deck support structure 11, such as bar joists, that are, in turn, supported on a wall 12. The structural support member 20, best shown in FIG. 2, comprises a substantially vertical outer segment 21 having an upper end 21*a* and a lower end 21*b* wherein the outer segment 21 is substantially co-planar with the outer surface 11*b* of the support structure 11. The structural support member 20 further comprises a substantially horizontal lower segment 22 having a first end 22*a* connected to the lower end 21*b* of the outer segment 21 and a second end 22*b*, a substantially horizontal upper segment 23 having a first end 23*a* connected to the upper end 21*a* of the outer segment 21 and a second end 23*b*, substantially horizontal intermediate segment 24 having a first end 24*a* connected to the outer segment 21 between the upper segment 23 and the lower segment 22 and a second end 24*b*, and a substantially vertical inner segment 25 having an upper end 25*a* connected to the second end 24*b* of the intermediate segment 24 and a lower end 25*b* connected to the lower segment 22 between the first end 22*a* and the second end 22*b* thereof.

The lower segment 22 of the structural support member is secured to the upper surface 11*a* of the support structure 11 and supports a metal deck 13. The upper segment 23, intermediate segment 24, and outer segment 21 of the structural support member 20 form a C-shaped cavity 26 for receiving the end of a barrier material 14, such as rigid insulation or lightweight concrete, which is supported on the metal deck 13. A roof membrane 15 is supported on the barrier material 14 and upper segment 23. The lower segment 22, intermediate segment 24, inner segment 25, and outer segment 21 of the structural support member 20 form an elongated channel 27 that preferably has a plurality of vent holes 28 therethrough to allow moisture and volatile gases to escape from the roof deck. The structural support member 20 preferably comprises two (2) galvanized steel sections, an outer section 29*a* and an inner section 29*b*, that are spot welded together to form a unitary structure.

Figure 4:
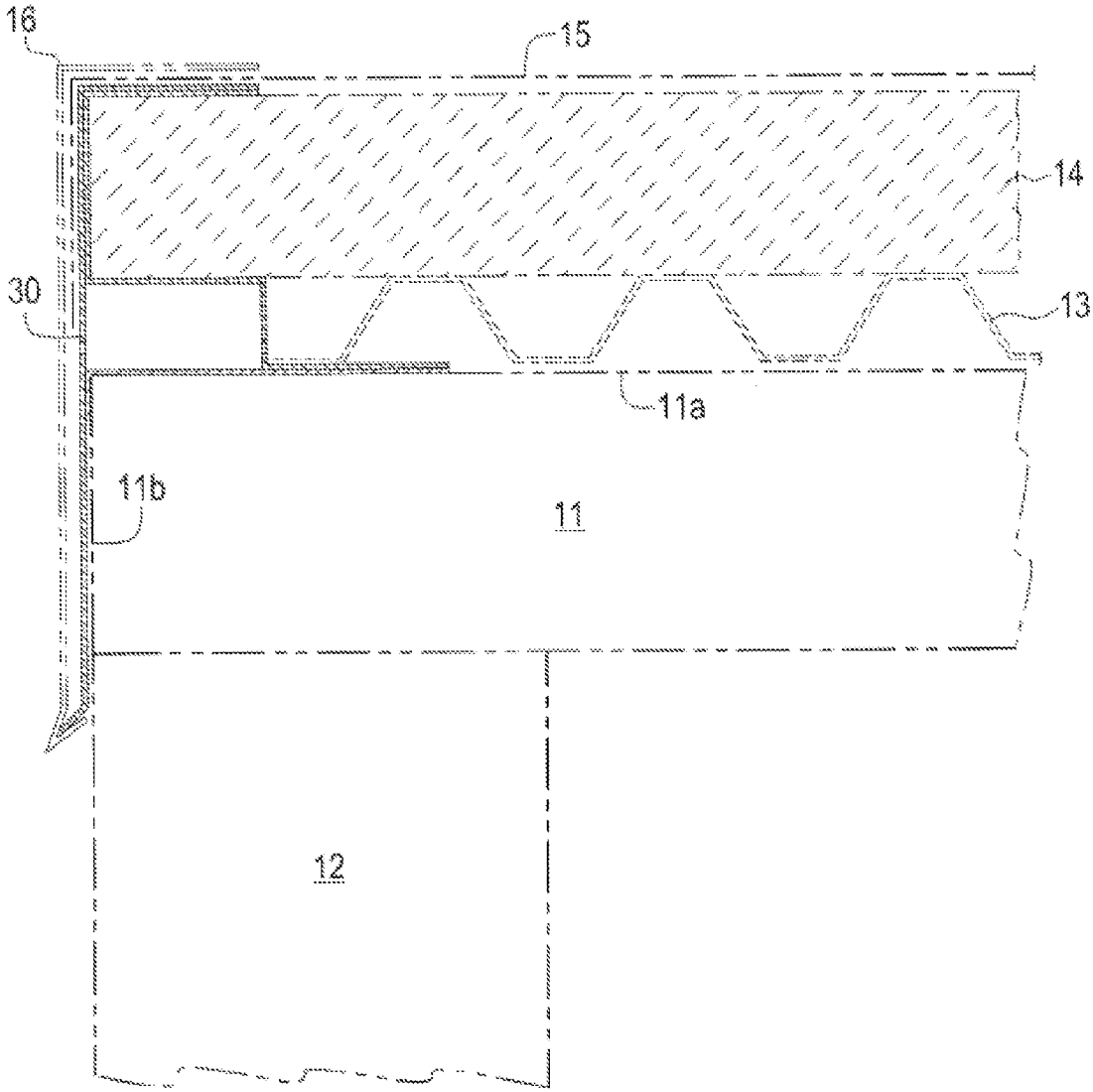
FIG. 4 is a side sectional view of a second embodiment of the present invention.
Figure 5:
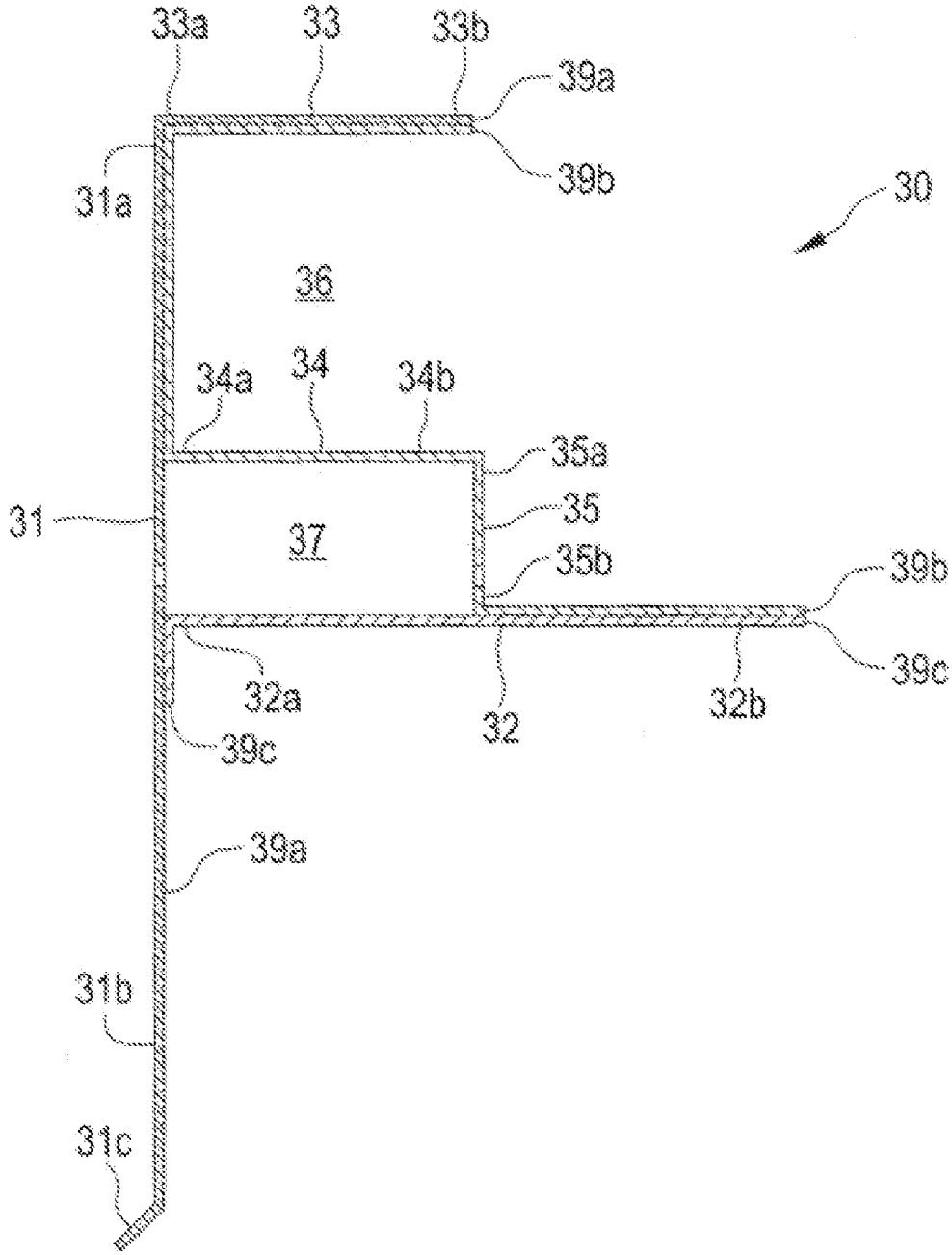
FIG. 5 is a side sectional view of the structural support member used in the embodiment of FIG. 4.
Figure 6:
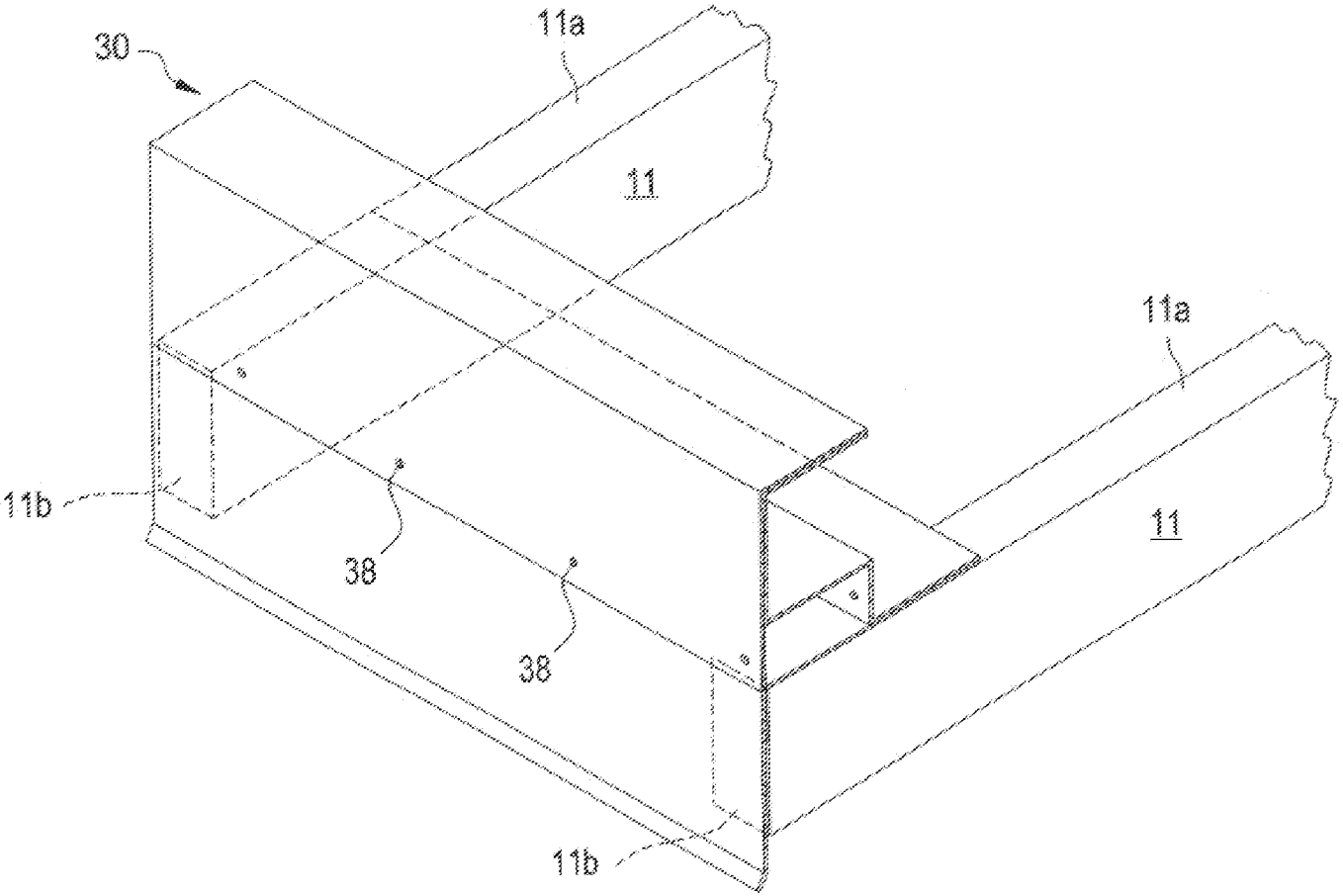
FIG. 6 is a perspective view of the structural support member used in the embodiment of FIG. 4 supported on bar joists.

In a second embodiment shown in FIGS. 4-6, a structural support member 30 is supported on an upper surface 11*a* of a roof deck support structure 11, such as bar joists, that are, in turn, supported on a wall 12. The structural support member 30, best shown in FIG. 5, comprises a substantially vertical outer segment 31 having an upper end 31*a* and a lower end 31*b* that overlaps the outer surface 11*b* of the support structure and is in a substantially parallel-planar relationship therewith. Because the outer segment 31 and the outer surface 11*b* of the support structure 11 are in parallel-planar relationship with each other and are in abutment with each other, they are substantially co-planar and are referred to herein as such. The vertical outer segment 31 may include an angled cleat 31*c* for securing fascia 16 thereto. The structural support member 30 further comprises a substantially horizontal lower segment 32 having a first end 32*a* connected to outer segment 31 and a second end 32*b*, a substantially horizontal upper segment 33 having a first end 33*a* connected to the upper end 31*a* of the outer segment 31 and a second end 33*b*, a substantially horizontal intermediate segment 34 having a first end 34*a* connected to the outer segment 31 between the upper segment 33 and the lower segment 32 and a second end 34*b*, and a substantially vertical inner segment 35 having an upper end 35*a* connected to the second end 34*b* of the intermediate segment 34 and a lower end 35*b* connected to the lower segment 32 between the first end 32*a* and the second end 32*b* thereof.

The lower segment 32 of the structural support member 30 is secured to the upper surface 11*a* of the support structure 11 and supports a metal deck 13. The upper segment 33, intermediate segment 34, and outer segment 31 of the structural support member 30 form a C-shaped cavity 36 for receiving the end of a barrier material 14, which is supported on the metal deck 13. A roof membrane 15 is supported on the barrier material 14 and upper segment 33. The lower segment 32, intermediate segment 34, inner segment 35, and outer segment 31 of the structural support member 30 form an elongated channel 37 that preferably has a plurality of vent holes 38 therethrough. The structural support member 30 preferably comprises three (3) galvanized steel sections, an outer section 39*a*, an upper section 39*b*, and a lower section 39*c*, that are spot welded together to form a unitary structure.

Figure 7:
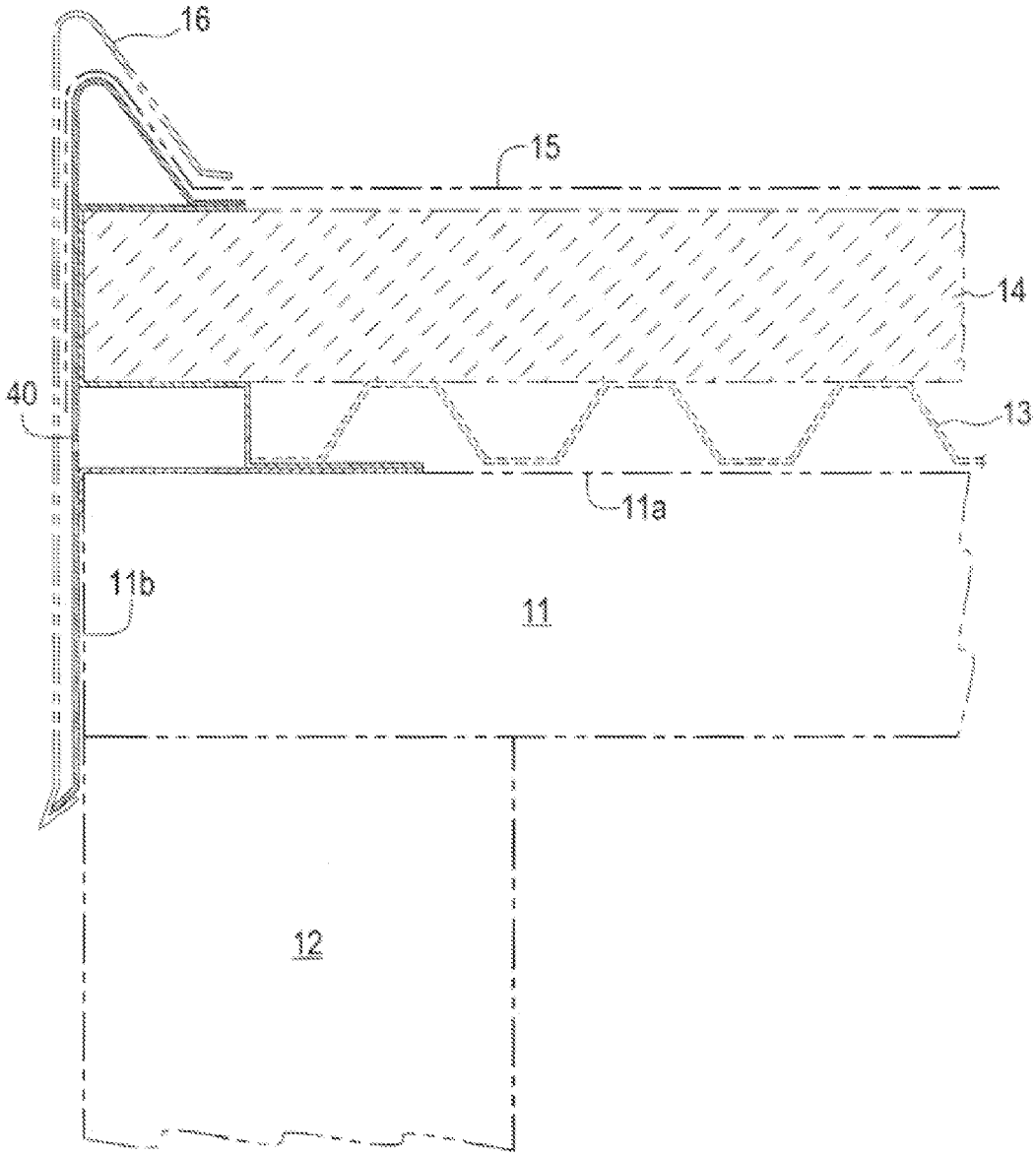
FIG. 7 is a side sectional view of a third embodiment of the present invention.
Figure 8:
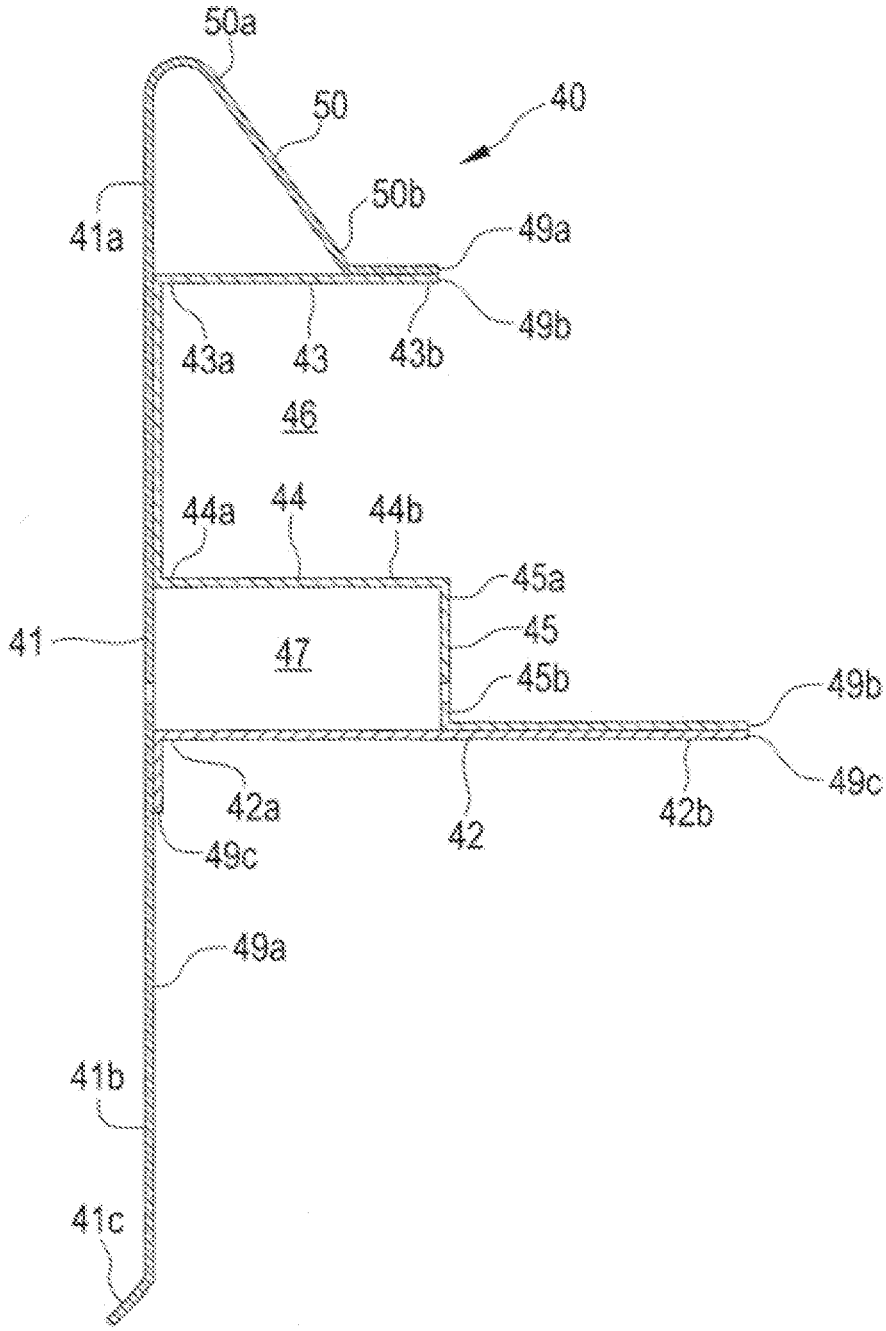
FIG. 8 is a side sectional view of the structural support member used in the embodiment of FIG. 7.
Figure 9:
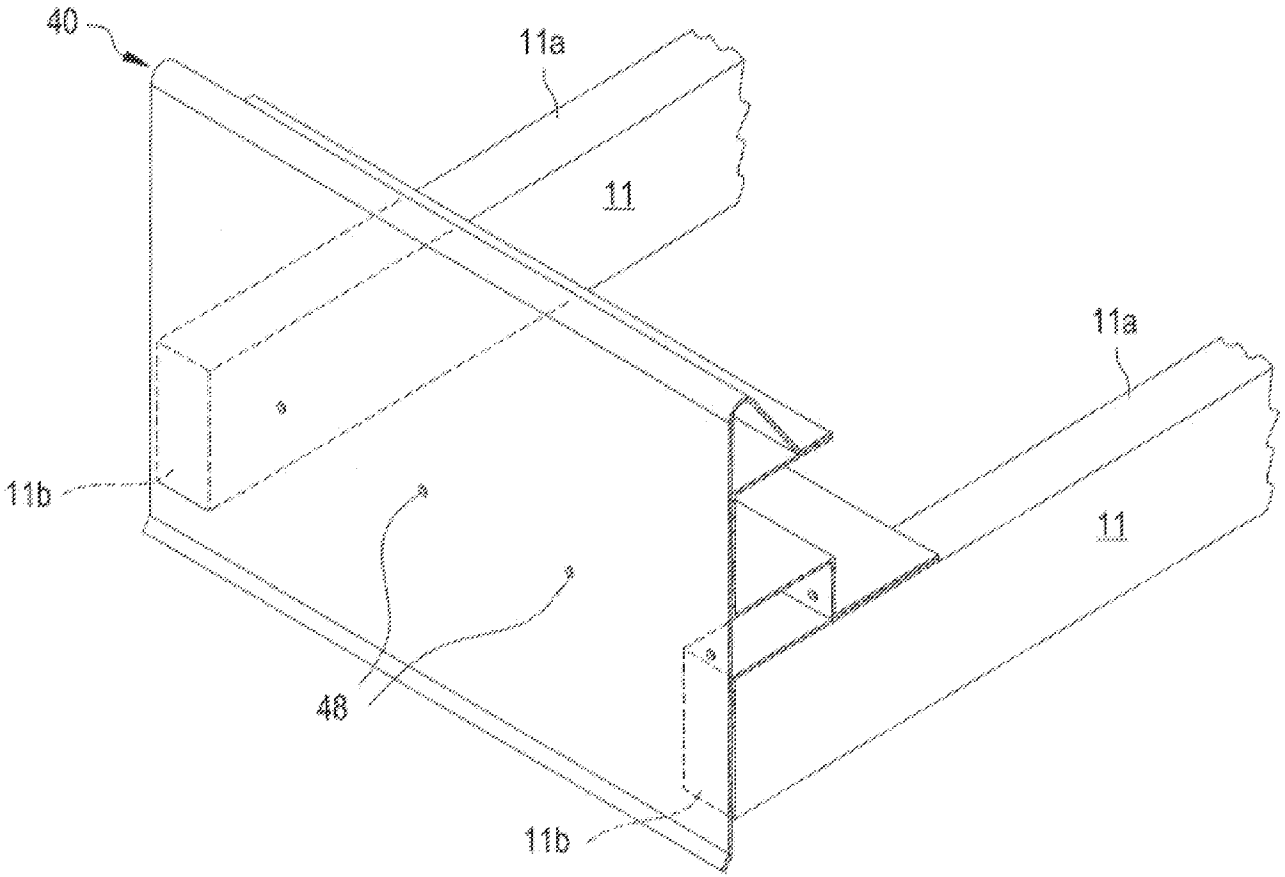
FIG. 9 is a perspective view of the structural support member used in the embodiment of FIG. 7 supported on bar joists.

In a third embodiment shown in FIGS. 7-9, a structural support member 40 is supported on an upper surface 11*a* of a roof deck support structure 11, such as bar joists, that are, in turn, supported on a wall 12. The structural support member 40, best shown in FIG. 8, comprises a substantially vertical outer segment 41 having an upper end 41*a* and a lower end 41*b* that overlaps the outer surface 11*b* of the support structure and is substantially co-planar therewith. Because the outer segment 41 and the outer surface 11*b* of the support structure 11 are in parallel-planar relationship with each other and are in abutment with each other, they are substantially co-planar and are referred to herein as such. The vertical outer segment 41 may include an angled cleat 41*c* for securing fascia 16 thereto. The structural support member 40 further comprises a substantially horizontal lower segment 42 having a first end 42*a* connected to the outer segment 41 and a second end 42*b*, a substantially horizontal upper segment 43 having a first end 43*a* connected to the outer segment 41 and a second end 43*b*, a substantially horizontal intermediate segment 44 having a first end 44*a* connected to the outer segment 41 between the upper segment 43 and the lower segment 42 and a second end 44*b*, a substantially vertical inner segment 45 having an upper end 45*a* connected to the second end 44*b* of the intermediate segment 44 and a lower end 45*b* connected to the lower segment 42 between the first end 42*a* and the second end 42*b* thereof, and an angled segment 50, or cant, having an upper end 50*a* connected to the upper end 41*a* of the outer segment 41 and a lower end 50*b* connected to the upper segment 43. Cants typically function as a barrier for roof gravel.

The lower segment 42 of the structural support member 40 is secured to the upper surface 11*a* of the support structure 11 and supports a metal deck 13. The upper segment 43, intermediate segment 44, and outer segment 41 of the structural support member 40 form a C-shaped cavity 46 for receiving the end of a barrier material 14, which is supported on the metal deck 13. A roof membrane 15 is supported on the barrier material 14 and angled segment 50. The lower segment 42, intermediate segment 44, inner segment 45, and outer segment 41 of the structural support member 40 form an elongated channel 47 that preferably has a plurality of vent holes 48 therethrough. The structural support member 40 preferably comprises three (3) galvanized steel sections, an outer section 49*a*, an upper section 49*b*, and a lower section 49*c*, that are spot welded together to form a unitary structure.

Figure 10:
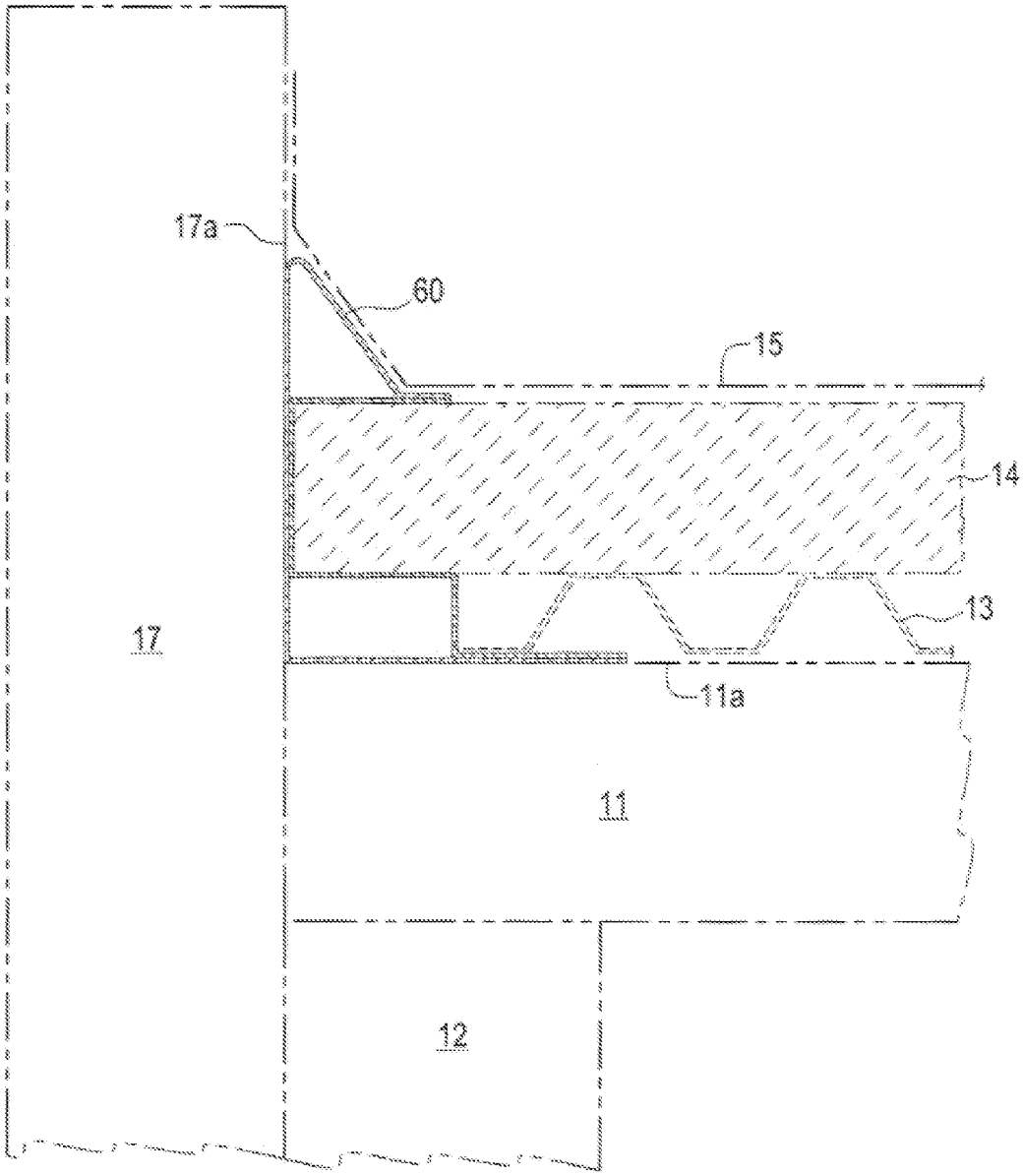
FIG. 10 is a side sectional view of a fourth embodiment of the present invention.
Figure 11:
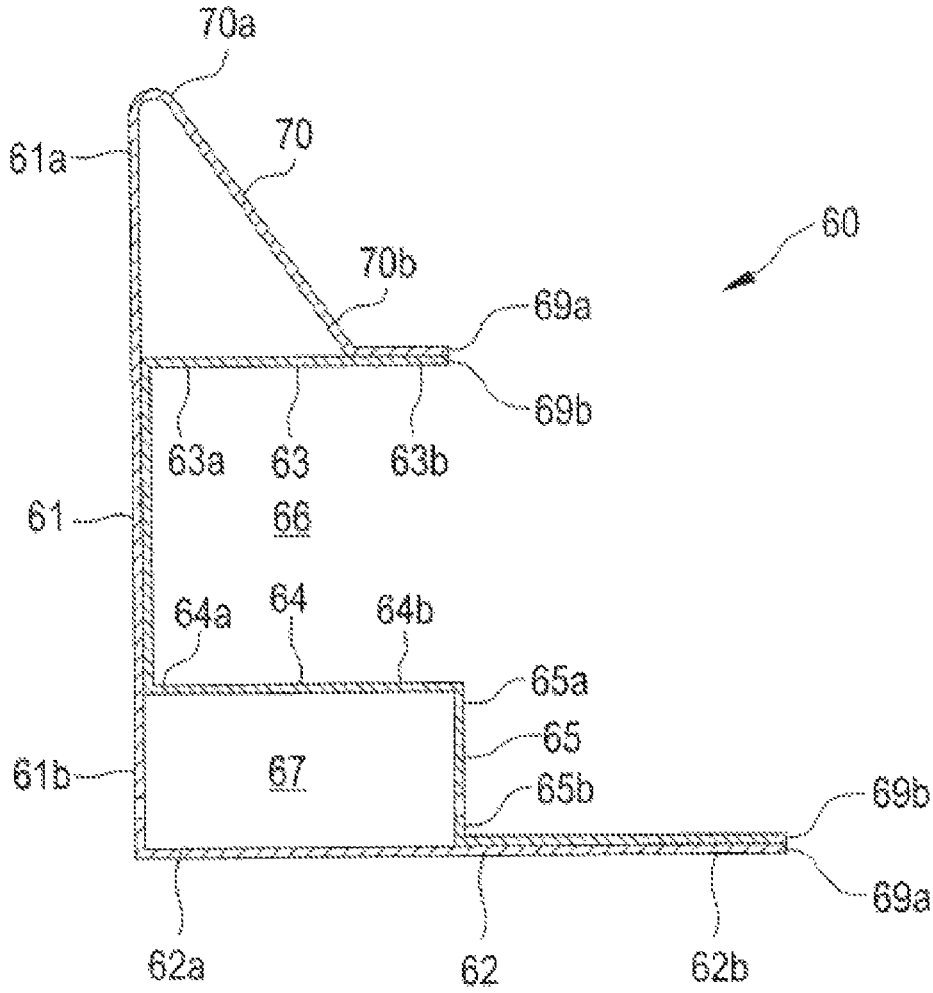
FIG. 11 is a side sectional view of the structural support member used in the embodiment of FIG. 10.
Figure 12:
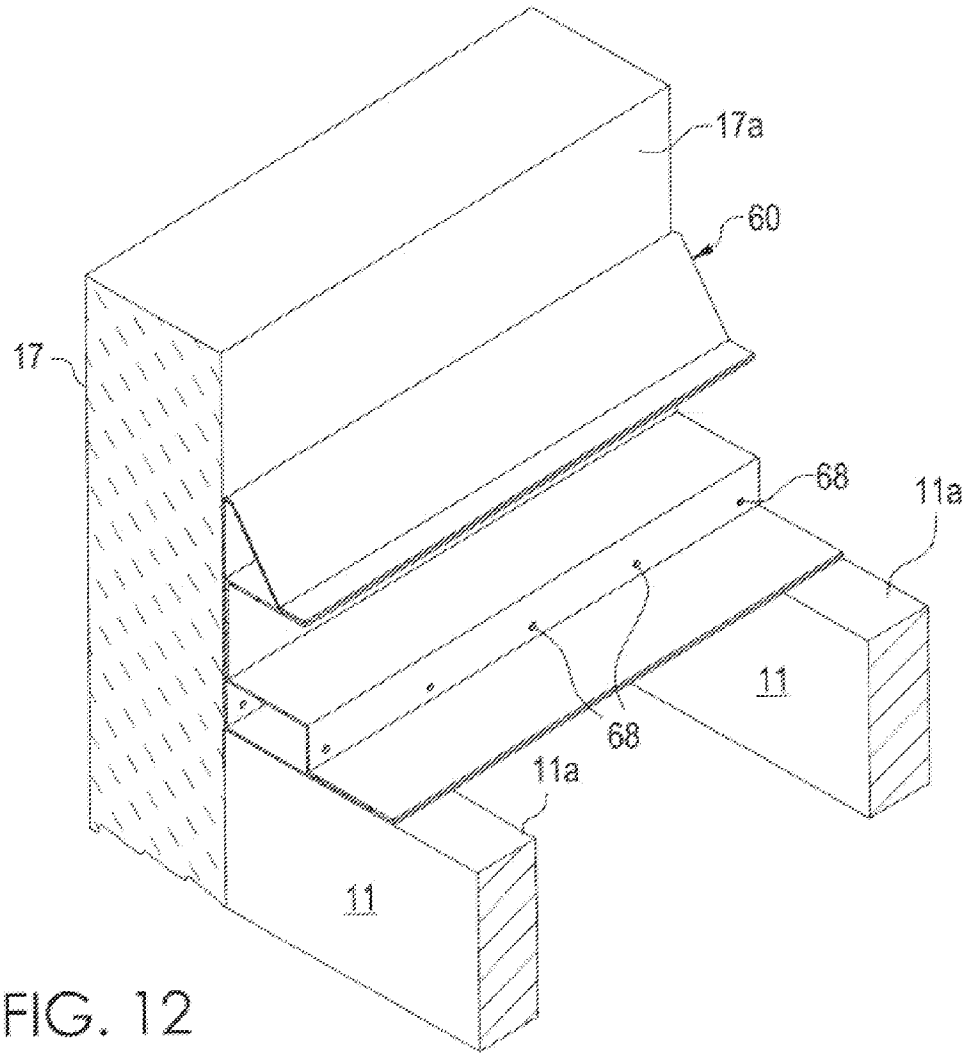
FIG. 12 is a perspective view of the structural support member used in the invention of FIG. 10 supported on bar joists and abutting a parapet wall.

In a fourth embodiment shown in FIGS. 10-12, a structural support member 60 is supported on an upper surface 11*a* of a roof deck support structure 11, such as bar joists, that are, in turn, supported on a wall 12. In this embodiment, the upper surface 11*a* of the roof deck support, structure 11 intersects an inner surface 17*a* of a parapet wall 17. The structural support member 60, best shown in FIG. 11, comprises a substantially vertical outer segment 61 having an upper end 61*a* and a lower end 61*b* wherein the outer segment 61 is substantially co-planar with the inner surface 17*a* of the parapet wall 17. Because the outer segment 61 and the inner surface 17*a* of the parapet wall 17 are in parallel-planar relationship with each other and are in abutment with each other, they are substantially co-planar and are referred to herein as such. The structural support member 60 further comprises a substantially horizontal lower segment 62 having a first end 62*a* connected to the lower end 61*b* of the outer segment 61 and a second end 62*b*, a substantially horizontal upper segment 63 having a first end 63*a* connected to the outer segment 61 and a second end 63*b*, a substantially horizontal intermediate segment 64 having a first end 64*a* connected to the outer segment 61 between the upper segment 63 and the lower segment 62 and a second end 64*b*, a substantially vertical inner segment 65 having an upper end 65*a* connected to the second end 64*b* of the intermediate segment 64 and a lower end 65*b* connected to the lower segment 62 between the first end 62*a* and the second end 62*b* thereof, and an angled segment 70, or cant, having an upper end 70*a* connected to the upper end 61*a* of the outer segment 61 and a lower end 70*b* connected to the upper segment 63.

The lower segment 62 of the structural support member 60 is secured to the upper surface 11*a* of the support structure 11 and supports a metal deck 13. The outer segment 61 is preferably secured to the inner surface 17*a* of the parapet wall 17. The upper segment 63, intermediate segment 64, and outer segment 61 of the structural support member 60 form a C-shaped cavity 66 for receiving the end of a barrier material 14, which is supported on the metal deck 13. A roof membrane 15 is supported on the barrier material 14 and angled segment 70. The lower segment 62, intermediate segment 64, inner segment 65, and outer segment 61 of the structural support member 60 form an elongated channel 67 that preferably has a plurality of vent holes 68 therethrough. The structural support member 60 preferably comprises two (2) galvanized steel sections, an outer section 69*a* and an inner section 69*b*, that are spot welded together to form a unitary structure.

While the invention has been shown and described in some detail with reference to specific exemplary embodiments, there is no intention that the invention be limited to such detail. On the contrary, the invention is intended to include any alternative or equivalent embodiments that fall within the spirit and scope of the invention as described herein and as recited in the appended claims.

The invention claimed is:

1. A structural support member for use in a roof deck system supported on an upper surface of a roof deck support structure, comprising:

a) a substantially vertical outer segment having a first end and a second end;

b) a substantially horizontal lower segment having a first end connected to said outer segment and a second end;

c) a substantially horizontal upper segment having a first end connected to said outer segment and a second end;

d) a substantially horizontal intermediate segment having a first end connected to said outer segment between said upper segment and said lower segment and a second end; and e) a substantially vertical inner segment having a first end connected to said second end of said intermediate segment and a second end connected to said lower segment between said first and second ends thereof;

f) wherein said upper segment, said intermediate segment, and said outer segment form a C-shaped cavity and the roof deck system comprises a barrier material, wherein said barrier material has an outer end that fills said C-shaped cavity;

g) wherein said lower segment, said intermediate segment, said inner segment, and said outer segment form an enclosed substantially rectangular-shaped channel having a plurality of vent holes through said inner segment and said outer segment to allow moisture and volatile gases to escape from the roof deck; and h) wherein said lower segment is secured to the upper surface of the support structure and the roof deck system further comprises a metal deck having an outer end secured on said lower segment between said inner segment and said second end of said lower segment, wherein said barrier material is supported on said metal deck.

2. A structural support member according to claim 1, wherein the support structure has a substantially vertical outer surface that intersects the upper surface at a corner and said outer segment overlaps the outer surface of the support structure and is substantially co-planar therewith.

3. A structural support member according to claim 1, further comprising an angled segment having a first end connected to said second end of said outer segment and a second end connected to said upper segment wherein said angled segment extends downwardly from said second end of said outer segment to said upper segment.

4. A structural support member according to claim 3, wherein the support structure has a substantially vertical outer surface that intersects the upper surface at a corner and said outer segment overlaps the outer surface of the support structure and is substantially co-planar therewith.

5. A structural support member according to claim 3, wherein the upper surface of the support structure intersects a substantially vertical parapet wall surface at a corner and said outer segment is secured to the parapet wall surface and is substantially co-planar therewith.

6. A structural support member according to claim 1, wherein the roof deck system further comprises a roof membrane supported on said barrier material and said upper segment of said support member.

7. A roof deck system, comprising:

a) a roof deck support structure having a substantially horizontal upper surface and a substantially vertical outer surface, wherein said upper surface and said outer surface intersect at a corner; and b) a structural support member having a substantially horizontal lower segment having a first end and a second end, a substantially vertical outer segment having a first end connected to said first end of said lower segment and a second end, a substantially horizontal upper segment having a first end connected to said second end of said outer segment and a second end, a substantially horizontal intermediate segment having a first end connected to said outer segment between said first and second ends thereof and a second end, and a substantially vertical inner segment having a first end connected to said second end of said intermediate segment and a second end connected to said lower segment between said first and second ends thereof;

c) wherein said upper segment, said intermediate segment, and said outer segment form an elongated C-shaped cavity and said roof deck system further comprises a barrier material, wherein said barrier material has an outer end that fills said C-shaped cavity;

d) wherein said lower segment, said intermediate segment, said inner segment, and said outer segment form an enclosed substantially rectangular-shaped channel having a plurality of vent holes through said inner segment and said outer segment to allow moisture and volatile gases to escape from the roof deck;

e) wherein said lower segment is secured to said upper surface of said support structure and said roof deck system further comprises a metal deck having an outer end secured on said lower segment between said inner segment and said second end of said lower segment, wherein said barrier material is supported on said metal deck; and f) wherein said outer segment is substantially co-planar with said outer surface of said support structure.

8. A roof deck system according to claim 7, further comprising a roof membrane supported on said barrier material and said upper segment.

9. A roof deck system, comprising:

a) a roof deck support structure having a substantially horizontal upper surface and a substantially vertical outer surface, wherein said upper surface and said outer surface intersect at a corner; and b) a structural support member having a substantially vertical outer segment having a first end and a second end, a substantially horizontal lower segment having a first end connected to said outer segment between said first and second ends thereof and a second end, a substantially horizontal upper segment having a first end connected to said second end of said outer segment and a second end, a substantially horizontal intermediate segment having a first end connected to said outer segment between said upper segment and said lower segment and a second end, and a substantially vertical inner segment having a first end connected to said second end of said intermediate segment and a second end connected to said lower segment between said first and second ends thereof;

c) wherein said upper segment, said intermediate segment, and said outer segment form a C-shaped cavity and said roof deck system further comprises a barrier material, wherein said barrier material has an outer end that fills said C-shaped cavity;

d) wherein said lower segment, said intermediate segment, said inner segment, and said outer segment form an enclosed substantially rectangular-shaped channel having a plurality of vent holes through said inner segment and said outer segment to allow moisture and volatile gases to escape from the roof deck;

e) wherein said lower segment is secured to said upper surface of said support structure and said roof deck system further comprises a metal deck having an outer end secured on said lower segment between said inner segment and said second end of said lower segment, wherein said barrier material is supported on said metal deck; and f) wherein said outer segment overlaps said outer surface of said support structure and is substantially co-planar therewith.

10. A roof deck system according to claim 9, further comprising a roof membrane supported on said barrier material and said upper segment.

11. A roof deck system, comprising:

a) a roof deck support structure having a substantially horizontal upper surface and a substantially vertical outer surface, wherein said upper surface and said outer surface intersect at a corner; and b) a structural support member having a substantially vertical outer segment having a first end and a second end, a substantially horizontal lower segment having a first end connected to said outer segment between said first and second ends thereof and a second end, a substantially horizontal upper segment having a first end connected to said outer segment between said lower segment and said second end of said outer segment and a second end, an angled segment having a first end connected to said second end of said outer segment and a second end connected to said upper segment wherein said angled segment extends downwardly from said second end of said outer segment to said upper segment, a substantially horizontal intermediate segment having a first end connected to said outer segment between said upper segment and said lower segment and a second end, and a substantially vertical inner segment having a first end connected to said second end of said intermediate segment and a second end connected to said lower segment between said first and second ends thereof;

c) wherein said upper segment, said intermediate segment, and said outer segment form a C-shaped cavity and said roof deck system further comprises a barrier material, wherein said barrier material has an outer end that fills said C-shaped cavity;

d) wherein said lower segment, said intermediate segment, said inner segment, and said outer segment form an enclosed substantially rectangular-shaped channel having a plurality of vent holes through said inner segment and said outer segment to allow moisture and volatile gases to escape from the roof deck;

e) wherein said lower segment is secured to said upper surface of said support structure and said roof deck system further comprises a metal deck having an outer end secured on said lower segment between said inner segment and said second end of said lower segment, wherein said barrier material is supported on said metal deck; and f) wherein said outer segment overlaps said outer surface of said support structure and is substantially co-planar therewith.

12. A roof deck system according to claim 11, further comprising a roof membrane supported on said barrier material and said angled segment of said support member.

* * * * *